US005896632A

United States Patent [19]

Sturino

[11] Patent Number: 5,896,632

[45] Date of Patent: Apr. 27, 1999

[54] FOOTBALL HELMET-SHAPED CREMATORY URN

[76] Inventor: David P. Sturino, 1348 Black Ridge Dr., El Paso, Tex. 79912

[21] Appl. No.: 09/130,030

[22] Filed: Aug. 6, 1998

[51] Int. Cl.[6] ..... A61G 17/00

[52] U.S. Cl. ..... 27/1; 40/722; 40/725; 40/538

[58] Field of Search ..... 27/1, 35; 2/424, 2/425, 9; D6/303; 40/722, 724, 725, 727, 728, 738, 743, 538; D99/3, 4, 5

[56] References Cited

U.S. PATENT DOCUMENTS

| | | | |
|---|---|---|---|
| D. 166,228 | 3/1952 | Salmon . | |
| D. 209,219 | 11/1967 | Goldstein et al. . | |
| D. 248,651 | 7/1978 | Zivica . | |
| D. 356,427 | 3/1995 | August . | |
| D. 367,350 | 2/1996 | Sigal . | |
| D. 396,561 | 8/1998 | Gregory | D6/303 |
| 3,650,379 | 3/1972 | La Montagne . | |
| 4,199,848 | 4/1980 | Kohnert | 27/1 |
| 4,244,303 | 1/1981 | Kurasik | 40/722 X |
| 4,658,523 | 4/1987 | Adell . | |
| 5,230,127 | 7/1993 | Zukowski et al. | 27/1 |
| 5,287,603 | 2/1994 | Schorman | 27/35 X |
| 5,625,933 | 5/1997 | Neuberger et al. | 27/35 X |
| 5,740,637 | 4/1998 | Snow | 27/35 X |
| 5,787,625 | 8/1998 | Yesbick . | |
| 5,815,848 | 10/1998 | Jarvis | 2/424 |

*Primary Examiner*—Brian K. Green
*Assistant Examiner*—William L. Miller
*Attorney, Agent, or Firm*—Stephen R. Greiner

[57] ABSTRACT

A crematory urn having an outer shell shaped like a stylized football helmet. A face mask extends forwardly from the shell. A transparent plastic sleeve is secured to the shell behind the face mask to display a photograph of the person whose cremated remains are disposed within the shell. A base is secured to the bottom of the shell for retaining such in an upright orientation. A transparent capping plate in the base permits the contents of the urn to be viewed.

9 Claims, 2 Drawing Sheets

FOOTBALL HELMET-SHAPED CREMATORY URN

FIELD OF THE INVENTION

The present invention relates generally to undertaking and, in particular, to a crematory urn having a photographic display.

BACKGROUND OF THE INVENTION

Due to the relatively high costs of traditional funerals and burial, cremation is becoming popular method for disposing of the dead. Cremated remains are typically stored in a small container or urn and, then, interred in a cemetery plot or mausoleum. Most crematory urns are plain in appearance and offer little to distinguish one set of cremated remains from another. If given the opportunity, it is believed that many individuals would choose to identify their cremated remains as those of a football fan for eternity.

SUMMARY OF THE INVENTION

In light of the problems associated with the known crematory urns, it is a principal object of the invention to provide a crematory urn resembling a modern football helmet in appearance which is capable of displaying, in a protected manner, a photograph of the individual whose cremated remains are positioned therein.

It is another object of the invention to permit an individual to support a chosen sport and sport's franchise even after death.

It is an object of the invention to provide improved elements and arrangements thereof in a crematory urn for the purposes described which is lightweight in construction, inexpensive in manufacture and fully dependable in use.

Briefly, the crematory urn in accordance with this invention achieves the intended objects by featuring a hollow shell shaped like a stylized football helmet and adapted to retain the cremated remains of an individual. The transparent front plate of a photograph shield is positioned closely adjacent the front wall of the shell. A pair of retaining tabs extend from the front plate against the side walls of the shell. The C-shaped bar of a face mask extends forwardly of the front plate and connects a pair of ties together. Screws extending through aligned apertures in the shell, photograph shield and ties secure such elements to one another. The urn is retained in an upright orientation by a flat-bottomed base secured to the underside of the shell.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
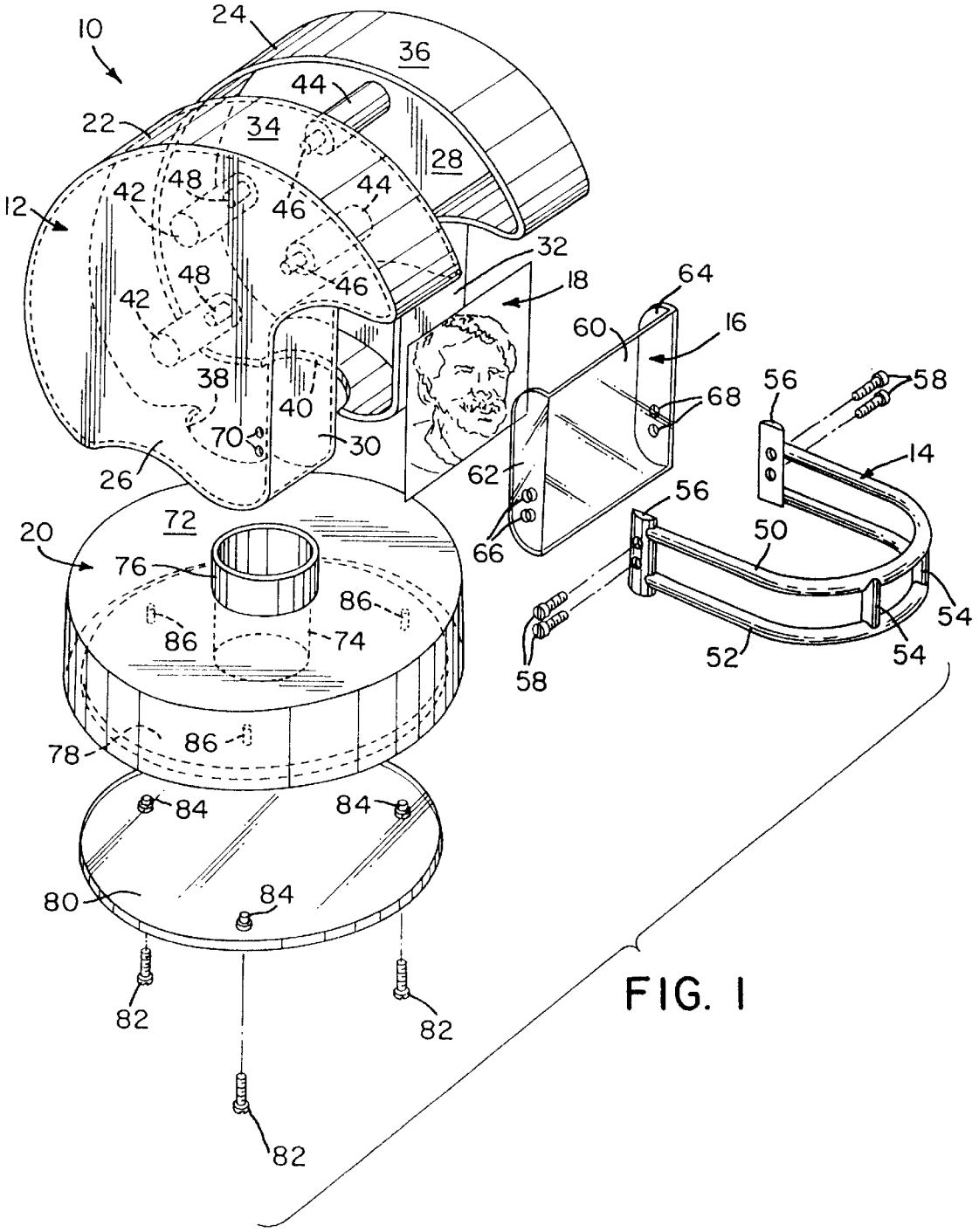
FIG. 1 is an exploded perspective view of a football helmet-shaped crematory urn in accordance with the present invention.
Figure 2:
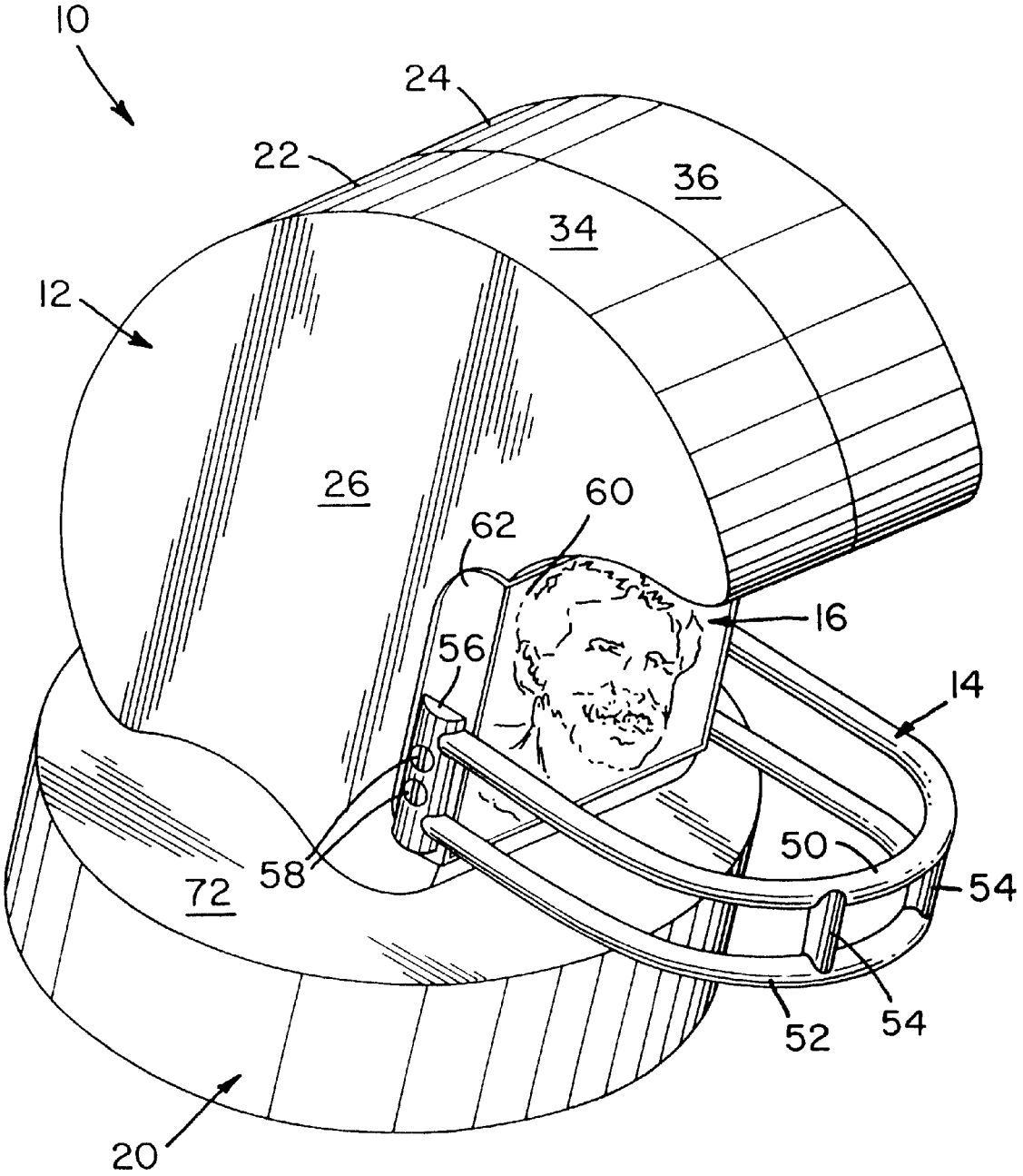
FIG. 2 is an unexploded perspective view of the football helmet-shaped crematory urn of FIG. 1.

Referring now to the FIGS., a football helmet-shaped crematory urn in accordance with the present invention is shown at 10. The urn 10 includes a hollow shell 12 configured like a stylized football helmet and sized to contain the cremated remains of an individual. A face mask 14 extends forwardly from the shell 12. Behind the face mask 14, a photograph shield 16 is secured for retaining and displaying a photograph 18. A base 20 is secured to the bottom of the shell 12 to support the shell in an upright position.

The shell 12 has a right part 22 joined to a left part 24 in a side-by-side relationship. The shell parts 22 and 24 include generally C-shaped side wall portions 26 and 28 defining the opposite sides of the shell 12. Extending at right angles from the front of the side wall portions 26 and 28 are concave wall portions 30 and 32 together forming the front wall of the shell 12. Extending at right angles from the top, bottom and rear of the side wall portions 26 and 28, however, are convex wall portions 34 and 36 together being the top, bottom and rear walls of the shell 12. Preferably, the bottoms of the concave wall portions 34 and 36 are provided with semicircular cutouts 38 and 40 which provide the shell 12 with an aperture.

The shell parts 22 and 24 are provided with posts 42 and 44 which may be brought into abutment with one another for ensuring the proper alignment of the shell parts during assembly and reinforcing the shell thereafter. Preferably, the posts 44 are spaced apart and extend at right angles from the shell part 28. A pin 46 of reduced diameter projects outwardly from the end of each of the posts 44. The posts 42, however, extend at right angles from the shell part 26 at positions selected to abut the posts 44. The posts 42 have sockets 48 in their free ends for snugly receiving the pins 46.

The face mask 14 includes a pair of C-shaped bars 50 and 52 joined in a side-by-side relationship by a plurality of laterally spaced ties 54 and 56. The ties 56 at one end of the face mask 14 are enlarged somewhat to accommodate the passage of screws 58 which rigidly secure the face mask 14 to the side wall portions 26 and 28 of the shell 12. As shown, the face mask 14 is oriented so that it projects forwardly of the front wall of the shell 12 in a manner similar to that of a real football helmet.

The shield 16 is molded from clear plastic and includes a front plate 60 adapted for positioning closely adjacent the concave wall portions 30 and 32 of the shell 12. Integral retaining tabs 62 and 64 extend rearwardly from the opposite ends of the front plate 60. The tabs 62 and 64 are configured for positioning between the ties 56 of the face mask 14 and the side wall portions 26 and 28 of the shell 12. Apertures 66 and 68 in the retaining tabs 62 and 64 permit the screws 58 to extend through the shield 16 and into apertures 70 in the side wall portions 26 and 28 so as to securely fasten such to the shell 12.

The base 20 includes a disk-shaped platform 72 having a hole 74 passing vertically through its center. Projecting upwardly from the platform 72 is a cylindrical sleeve 76 which serves to extend the hole 74 upwardly a short distance. The external surface of the sleeve 76 is sized, as shown, for snug engagement with the periphery of the aperture formed by cutouts 38 and 40 in the shell 12.

The bottom of the hole 74 is enlarged somewhat so as to provide such with a recessed, peripheral flange 78. The flange 78 supports a transparent, capping plate 80 which seals the hole 74 and permits the contents of the shell 12 to be viewed. The plate 80 is removably secured to the platform 72 by screws 82. The screw 82 are fitted within countersunk apertures 84 in the capping plate 80 and in aligned, threaded apertures 86 in the recessed flange 78 of the platform 72.

Assembly and use of the urn 10 are straightforward. First, the right and left parts 22 and 24 are secured together by an adhesive cement or other suitable means. The cylindrical sleeve 76 of the base 20 is, next, inserted into the aperture formed by the cutouts 38 and 40 and adhesively secured there. Now, the shell 12 may be filled with an individual's cremated remains funneled through the hole 74 in the platform 72. The remains are sealed within the urn 10 by securing the capping plate 80 against the recessed flange 78 with screws 82. A photograph 18 of the cremated individual is sandwiched between the front wall of the shell 12 and the front plate 60 of the shield 16. Finally, screws 58 are employed to secure the shield 16, photograph 18, and face mask 14 to the shell 12.

While the invention has been described with a high degree of particularity, it will be appreciated by those skilled in the art that modifications may be made thereto. For example, the urn may be provided with name plates, decals, logos and other indicia identifying the interred individual or chosen football team. Furthermore, the hollow shell and face mask could be provided with different ornamental designs so that headgear used in a variety of sports such as: baseball, hockey, lacrosse and automobile racing could be simulated. Therefore, it is to be understood that the present invention is not limited to the sole embodiment described above, but encompasses any and all embodiments within the scope of the following claims.

I claim:

1. A crematory urn, comprising:

a hollow shell adapted to receive and retain cremated remains, said hollow shell having a pair of opposed side walls and a front wall therebetween, each of said side walls respectively having a first aperture therein;

a shield for releasably securing a photograph to said hollow shell, said shield having a transparent front plate positioned adjacent said front wall and further having a pair of retaining tabs extending from said transparent front plate positioned adjacent said opposed side walls, each of said retaining tabs respectively having a second aperture therein for axial alignment with one said first aperture;

a face mask having a pair of ties each positioned adjacent a respective one of said retaining tabs, each of said ties respectively having a third aperture therein for axial alignment with one said second aperture, said face mask further having a C-shaped bar extending forwardly of said transparent front plate and connecting said ties together; and, a pair of screws, each of said screws respectively extending through one of said third apertures, through one of said second apertures, and into one of said first apertures so as to secure said shield and said face mask onto said hollow shell.

2. The crematory urn according to claim 1 further comprising a base secured to the bottom of said hollow shell for retaining such in an upright orientation.

3. The crematory urn according to claim 2 wherein said base includes:

a platform for stable positioning upon a horizontal surface, said platform having a hole therein being in communication with the interior of said hollow shell, and said hole having a recessed flange; and, a transparent capping plate positioned within said hole and in abutment with said recessed flange so as to seal said hole.

4. The crematory urn according to claim 1 wherein said hollow shell includes:

a right part having a pair of first alignment posts extending outwardly therefrom, each of said first alignment posts having a pin extending from the free end thereof; and, a left part joined to said right part, said left part having a pair of second alignment posts abutting said pair of first alignment posts, each of said second alignment posts having a socket in the free end thereof for receiving, respectively, one said pin.

5. A crematory urn, comprising:

a hollow shell for retaining cremated remains, said hollow shell further having a pair of opposed side walls and a front wall therebetween;

a photograph shield having a transparent front plate positioned closely adjacent said front wall and further having a pair of retaining tabs extending from said transparent front plate and positioned against said opposed side walls;

a face mask having a pair of ties each respectively positioned adjacent one of said retaining tabs, said face mask further having a C-shaped bar extending forwardly of said transparent front plate and connecting said ties together;

a pair of fasteners, each of said fasteners respectively extending through: one of said opposed side walls, one of said retaining tabs and one of said ties so as to secure said photograph shield and said face mask onto said hollow shell; and, a base having a platform secured to the bottom of said hollow shell for retaining such in an upright orientation, said platform having a hole in communication with the interior of said hollow shell, said base further having a capping plate removably positioned within said hole so as to selectively seal said hole.

6. The crematory urn according to claim 5 wherein said capping plate is formed of a transparent material so that the interior of said hollow shell may be viewed through said hole.

7. The crematory urn according to claim 5 wherein said hollow shell includes:

a right part having a pair of first alignment posts extending outwardly therefrom, each of said first alignment posts having a pin extending from the free end thereof; and, a left part joined to said right part, said left part having a pair of second alignment posts abutting said pair of first alignment posts, each of said second alignment posts having a socket in the free end thereof for receiving, respectively, one said pin.

8. A crematory urn, comprising:

a hollow shell for retaining cremated remains, said hollow shell having an opening in the bottom thereof, said hollow shell further having a pair of opposed side walls and a front wall therebetween;

a photograph shield having a transparent front plate for retaining a photograph against said front wall and for covering the photograph, said photograph shield further having a pair of retaining tabs extending from said transparent front plate positioned against said opposed side walls;

a face mask having a pair of ties each respectively positioned adjacent one of said retaining tabs, said face mask further having a pair of C-shaped bars extending forwardly of said transparent front plate and connecting said ties together;

a plurality of screws, each of said screws respectively extending through: one of said opposed side walls, one of said retaining tabs, and one of said ties so as to secure said photograph shield and said face mask onto said hollow shell; and, a base for retaining said hollow shell in an upright orientation, said base having a cylindrical sleeve extending from said platform into said opening in said hollow shell, said base also having a platform extending outwardly from said sleeve for positioning upon a support surface, said cylindrical sleeve and said platform having a hole passing therethrough in communication with the interior of said hollow shell, said base further having a transparent capping plate removably positioned within said hole for sealing said hole.

9. The crematory urn according to claim 8 wherein said hollow shell includes:

a right part having a pair of first alignment posts extending outwardly therefrom, each of said first alignment posts having a pin extending from the free end thereof; and, a left part joined to said right part, said left part having a pair of second alignment posts abutting said pair of first alignment posts, each of said second alignment posts having a socket in the free end thereof for receiving, respectively, one said pin.

* * * * *